US006655176B1

(12) United States Patent
Wang

(10) Patent No.: US 6,655,176 B1
(45) Date of Patent: Dec. 2, 2003

(54) STRIPING APPARATUS FOR CIRCULAR KNITTING MACHINES

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 10/180,318

(22) Filed: Jun. 27, 2002

(51) Int. Cl.[7] ..... D04B 15/58
(52) U.S. Cl. ..... 66/140 R; 66/139
(58) Field of Search ..... 66/139, 134, 135, 66/136, 137, 140 R, 142, 125 R

(56) References Cited

U.S. PATENT DOCUMENTS 4,193,274 A * 3/1980 Gostelow ..... 66/140 R
4,385,507 A * 5/1983 Sawazaki ..... 66/140 R
4,404,821 A * 9/1983 Johnson et al. ..... 66/139
4,606,202 A * 8/1986 Del Bene et al. ..... 66/134
4,656,842 A * 4/1987 Sawazaki et al. ..... 66/139
5,046,333 A * 9/1991 Sawazaki et al. ..... 66/140 R
5,070,709 A * 12/1991 Guell ..... 66/140 R
5,218,845 A * 6/1993 Wang ..... 66/139
5,826,446 A * 10/1998 Plath et al. ..... 128/898
6,000,245 A * 12/1999 Plath et al. ..... 66/139
6,408,655 B1 * 6/2002 Ossensi et al. ..... 66/140 R

* cited by examiner

*Primary Examiner*—Danny Worrell
(74) *Attorney, Agent, or Firm*—Birch, Stewart, Kolasch & Birch, LLP

(57) ABSTRACT

A striping apparatus for a circular knitting machine includes a control mechanism, an operation mechanism driven by the control mechanism, an adjusting mechanism mounted onto the control mechanism and a release mechanism located in the operation mechanism. The striping apparatus is installed on the circular knitting machine and is controlled by the yarn releasing and receiving cam and the color selection device, and may feed different colored yarns to the knitting needles to produce striped jacquard knitting fabrics.

15 Claims, 12 Drawing Sheets

STRIPING APPARATUS FOR CIRCULAR KNITTING MACHINES

FIELD OF THE INVENTION

The present invention relates to a striping apparatus for circular knitting machines and particularly a striping apparatus installed on a circular knitting machine for feeding discolored yarns.

BACKGROUND OF THE INVENTION

In the present techniques for circular knitting machines to do jacquard knitting of fabrics with different colors, it is generally done by installing a striping apparatus above the yarn feeding aperture. During knitting operations, the striping apparatus feeds colored yarns at desired times to the yarn feeding aperture for the knitting needles to pick up and to include in the knitting operations to produce jacquard patterns of different colors.

It happens that some striping apparatus are not properly installed. As a result, when the operator of the knitting machine performs repairs or replaces parts, the entire striping apparatus has to be removed. It incurs a lot of inconveniences. In conventional knitting machines, some striping apparatus are installed adjacent to the knitting needles and straddle the push needle cam of the upped needle dial. When to do color jacquard knitting, the yarn guiding element of the striping apparatus feeds the color yarn above the knitting needle so that the knitting needle picks up the color yarn to include in the knitting operation. However, when there is a requirement to replace or repair the needle cylinder, knitting needles, upper needle dial, sinker plate and push needle cam, the entire striping apparatus has to be removed. It causes a great inconvenience to the operator of the knitting machine, and results in waste of time and productive operations. Moreover, the installation of the striping apparatus mentioned above leaves no additional space in the knitting machine to change another set of components such as the needle cylinder, knitting needles, upper needle dial, sinker plate and push needle cam to knit different types of fabrics.

SUMMARY OF THE INVENTION

Therefore the primary object of the invention is to resolve the aforesaid disadvantages. The striping apparatus of the invention has redesigned needle cylinder, knitting needles, upper needle dial, sinker plate and push needle cam so that when there is a need to do replacement, repairs, or removing of the floss, the striping apparatus can be removed easily or even remain without being removed. As a result, replacement, repairs, or removing the floss becomes much easier. In addition, the knitting machine has an additional space for changing to another set of needle cylinder, knitting needles, upper needle dial, sinker plate and push needle cam to knit different types of fabrics.

In order to achieve the aforesaid object, the striping apparatus of the invention includes a control mechanism, an operation mechanism driven by the control mechanism, an adjusting mechanism mounted onto the control mechanism and a release mechanism located in the operation mechanism. The striping apparatus is installed on a knitting machine and is controlled by the yarn releasing and receiving cam and the color selection device, and may feed different colored yarns to the knitting needles to produce striped jacquard knitting fabrics.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
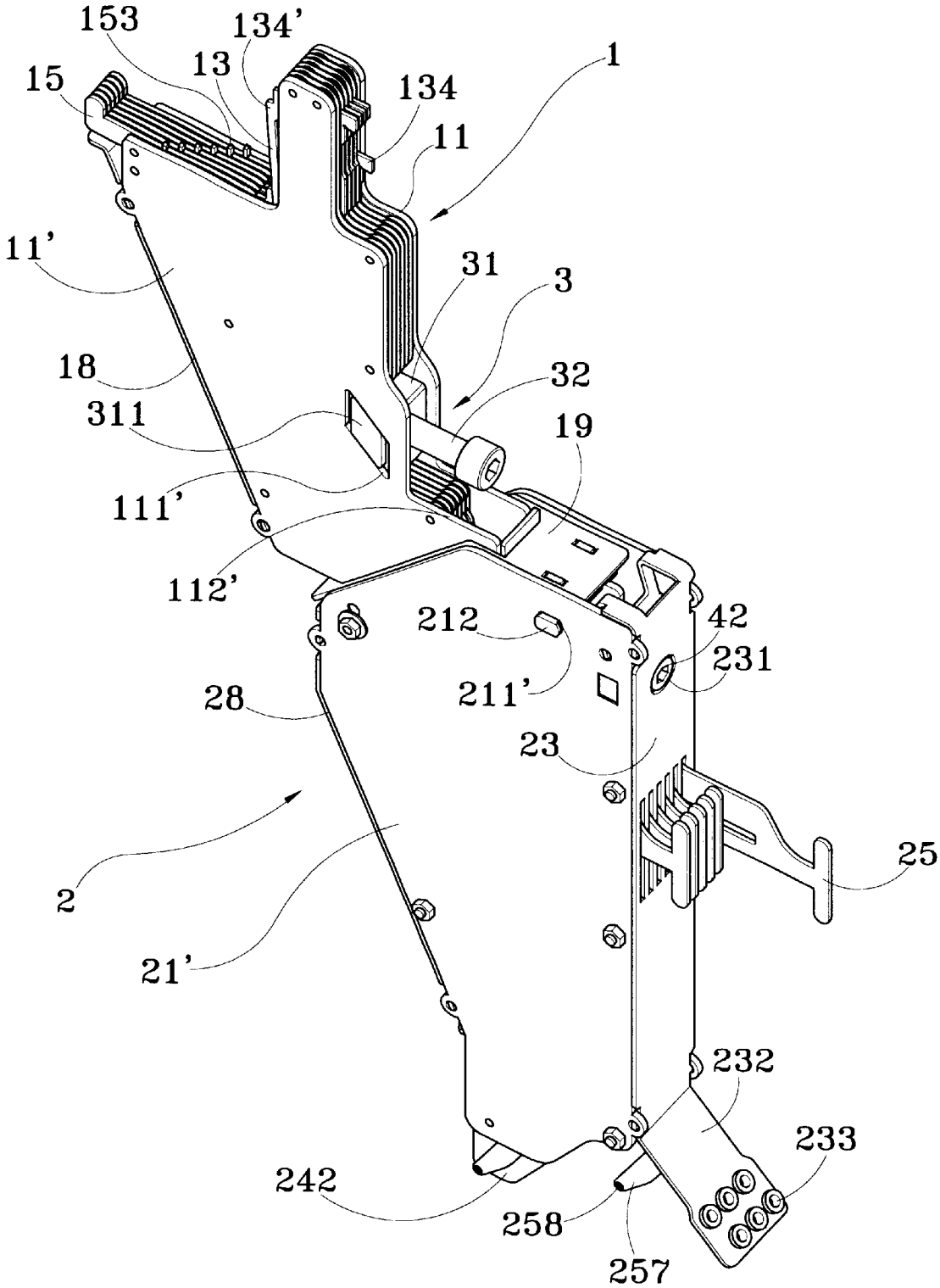
FIG. 1 is a perspective view of the striping apparatus of the invention.
Figure 2A:
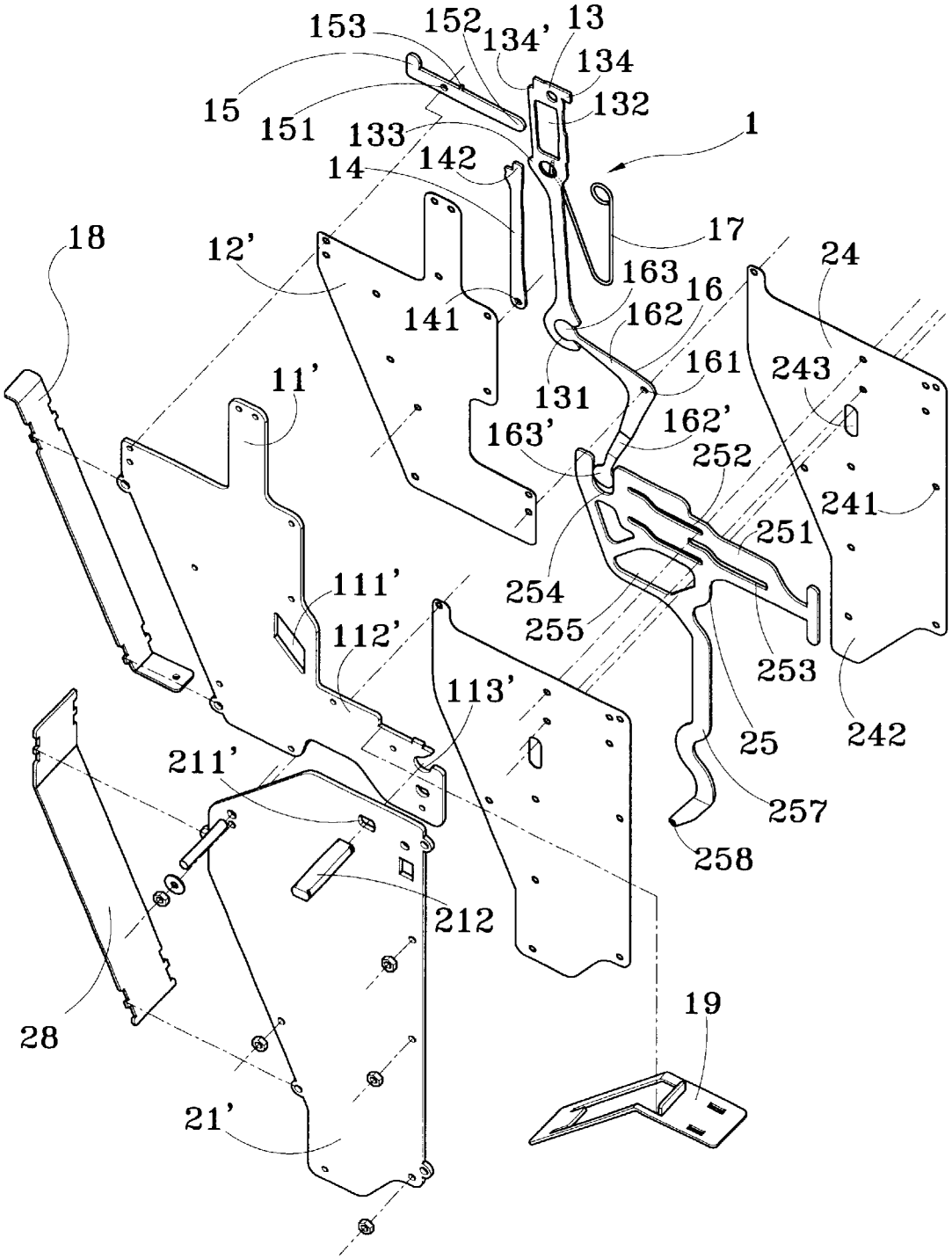
FIG. 2A is a fragmentary exploded view of the invention according to FIG. 1.
Figure 2B:
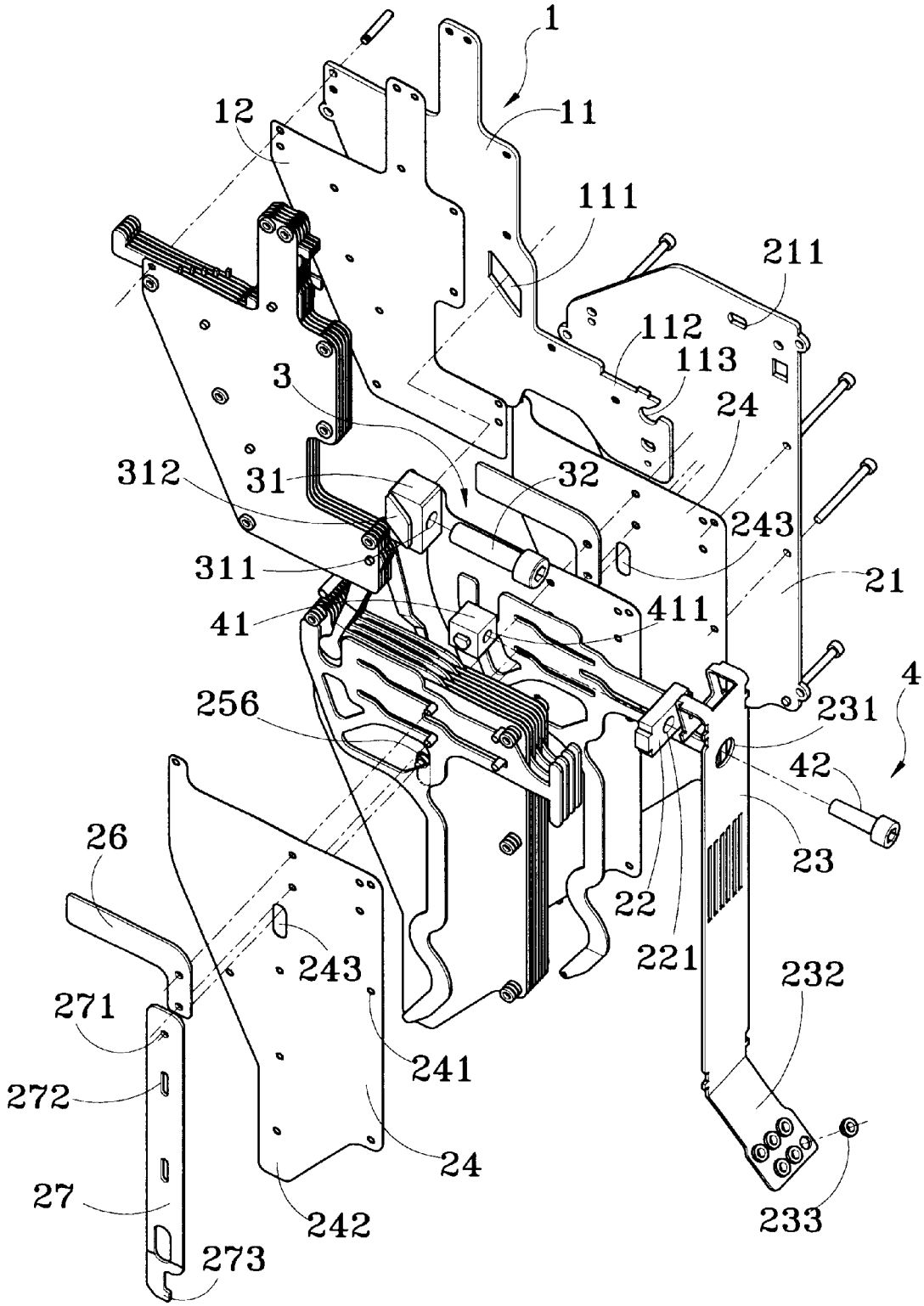
FIG. 2B is another fragmentary exploded view of the invention according to FIG. 1.

Referring to FIGS. 1, 2A, and 2B, the striping apparatus for circular knitting machines of the invention includes a control mechanism 1, an operation mechanism 2 driven by the control mechanism 1, an adjusting mechanism 3 mounted onto the control mechanism 1 and a release mechanism 4 located in the operation mechanism 2. The striping apparatus is installed on a knitting machine and is controlled by a yarn releasing and receiving cam (not shown in the drawings) and a color selection device (not shown in the drawings), and can feed colored yarns to the knitting needles to produce colored jacquard knitting fabrics.

The control mechanism 1 includes two outer plates 11 and 11', at least one dividing plate 12 (12') located between the two outer plates 11 and 11', and a yarn push blade 13, a color selection press blade 14, a color selection blade 15, a linkage blade 16 and an elastic element 17 pivotally engaged with each dividing plate 12 (12'). The two outer plates 11 and 11' further has a pair of first openings 111 and 111' corresponding to each other for pivotally engaging with the adjusting mechanism 3. The outer plates 11 and 11' have respectively one end extended to form a connecting section 112 and 112' which has a pivotal connecting trough 113 and 113' formed thereon corresponding to each other for pivotally engaging with the operation mechanism 2.

The yarn push blade 13 has a front end with a pivotal connection trough 131 formed thereon to pivotally engage with the linkage blade 16, a second opening 132 formed on a selected location to enable the yarn push blade 13 to move in the control mechanism 1, and a fin 133 located on another end to receive the pressing of the color selection press blade 14, and a first lug 134 and a second lug 134' located on yet another end corresponding to each other.

The color selection press blade 14 has an aperture 141 to pivotally engage with the control mechanism 1 and a jutting press end 142 located on one end thereof.

The color selection blade 15 has a hole 151 for pivotally engaging with the control mechanism 1, a front end formed a bucking section 152 to push the press end 142 and a jutting end 153 located on another end thereof to receive the pressing of the color selection device (not shown in the drawings).

The linkage blade 16 has a bore 161 for pivotally engaging with the control mechanism 1 and two arms 162 and 162' extended from two sides of the bore 161. One arm 162 has one end formed a first pivotal connection end 163 to pivotally engage with the pivotal connection trough 131 of the yarn push plate 13 and the other arm 162' has one end formed a second pivotal connection end 163' to pivotally engage with the interior of the operation mechanism 2.

Figure 3A:
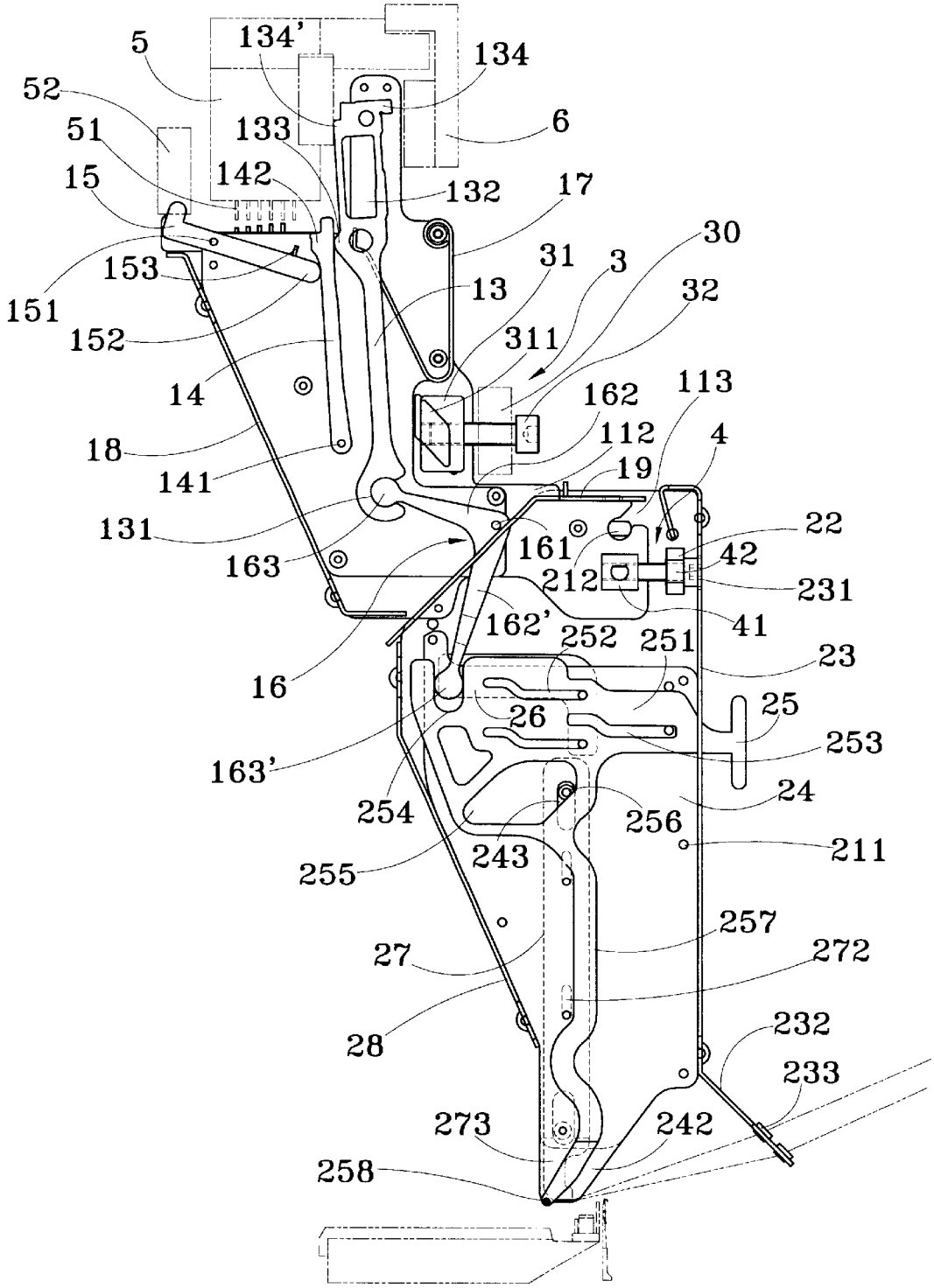
FIGS. 3A through 3D are schematic views of the striping apparatus of the invention in various operating conditions.
Figure 3B:
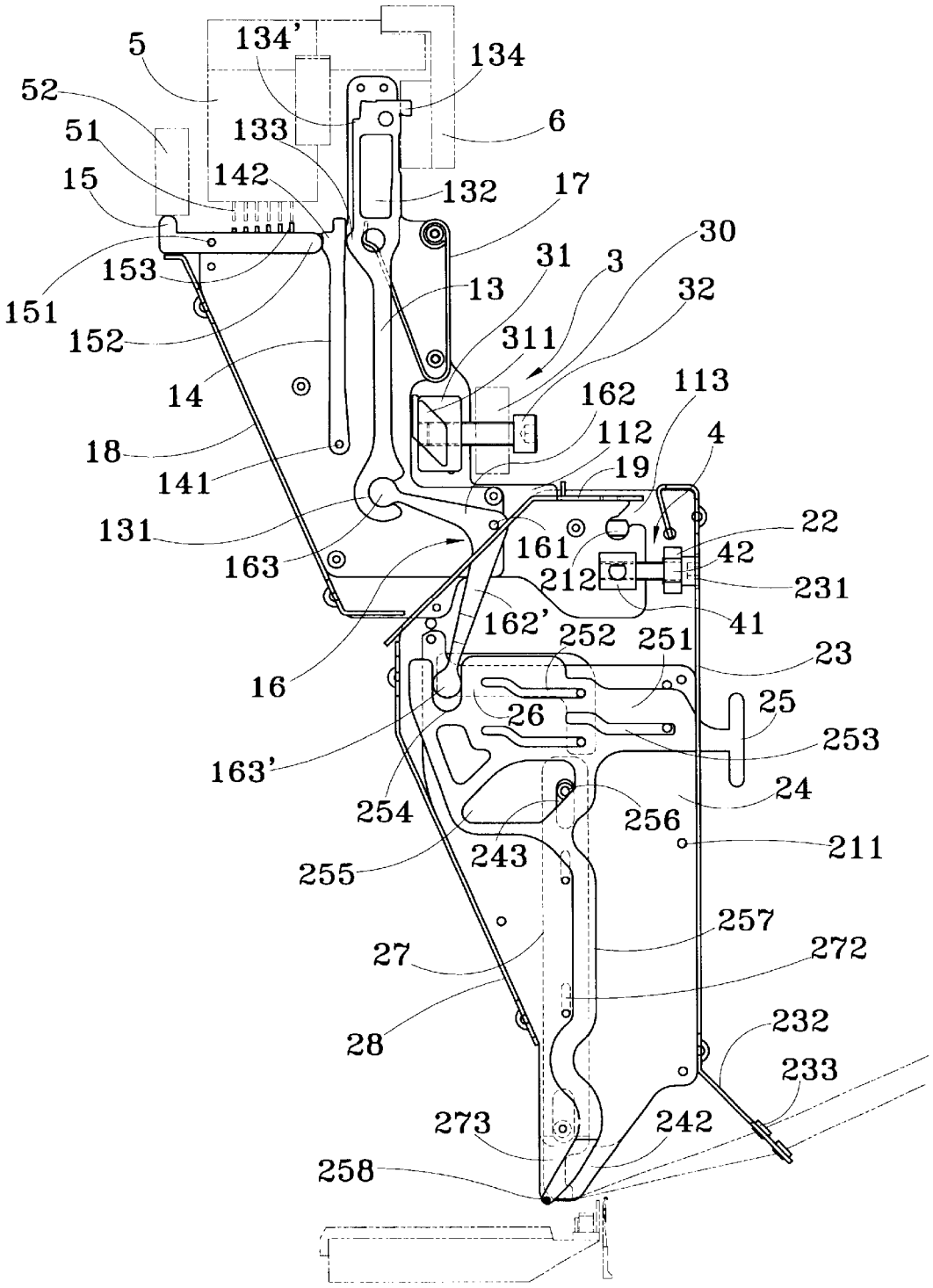
Figure 3C:
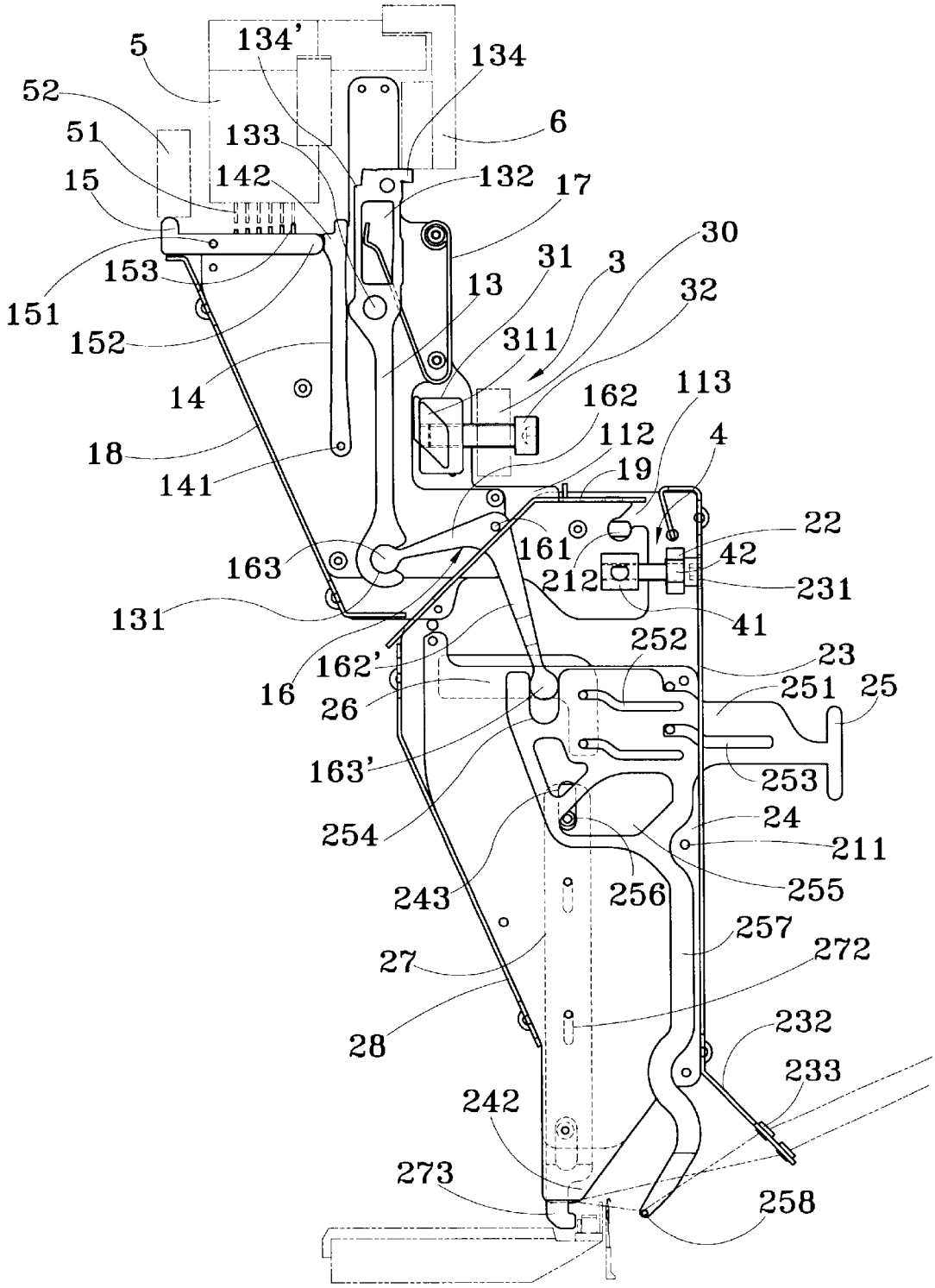
Figure 3D:
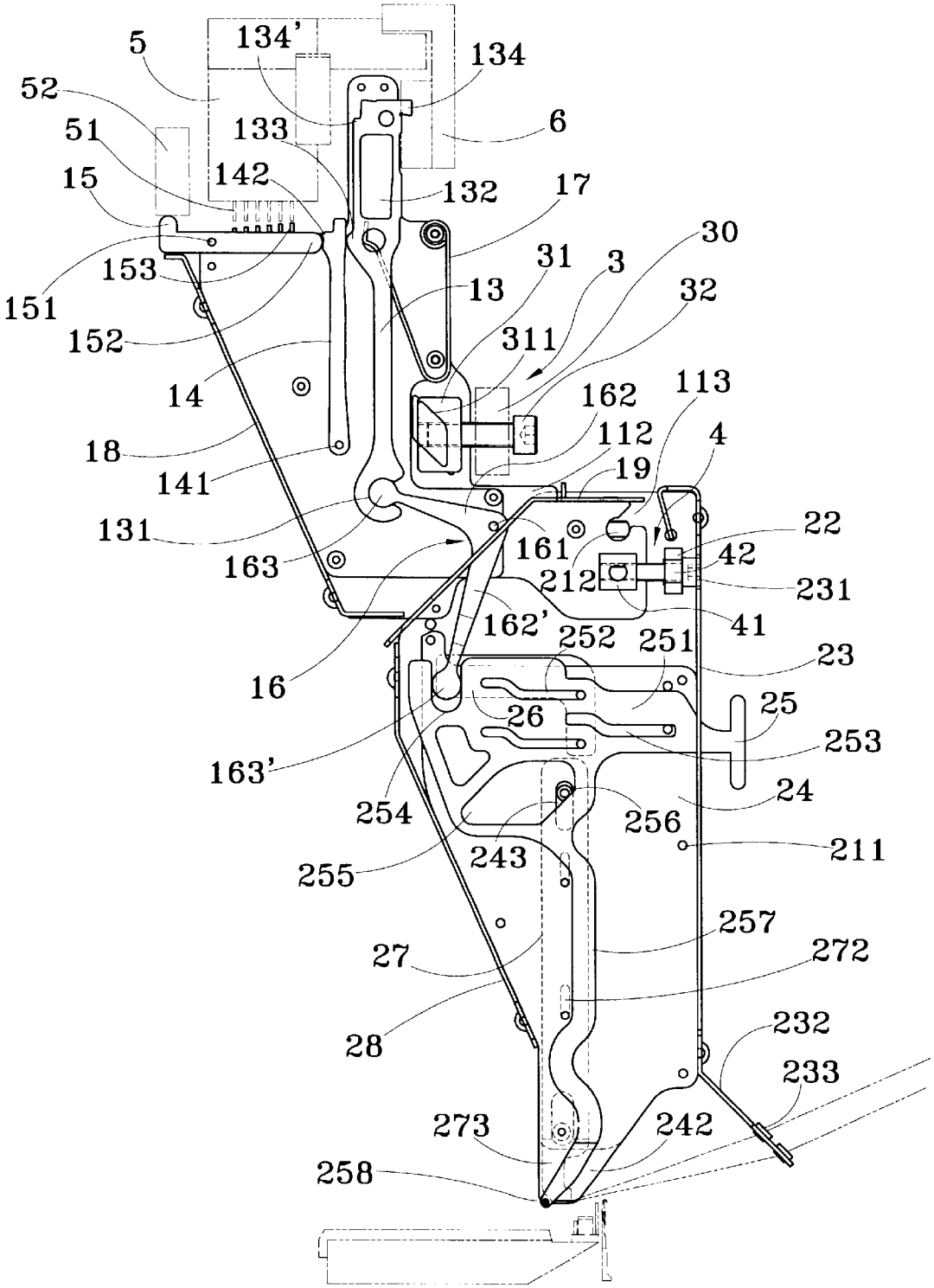
Figure 4A:
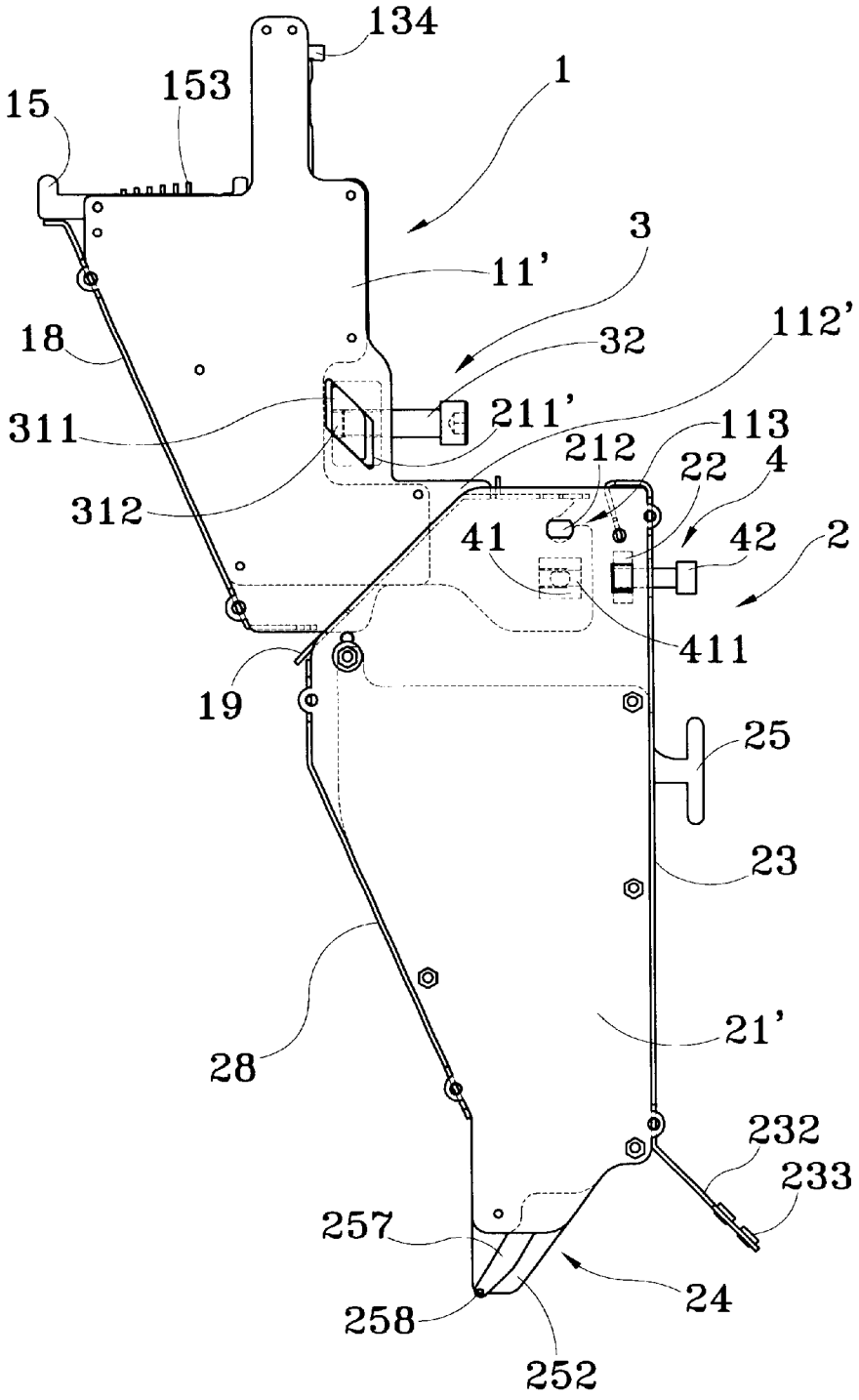
FIGS. 4A through 4D are schematic views of the striping apparatus of the invention in other operating conditions.
Figure 4B:
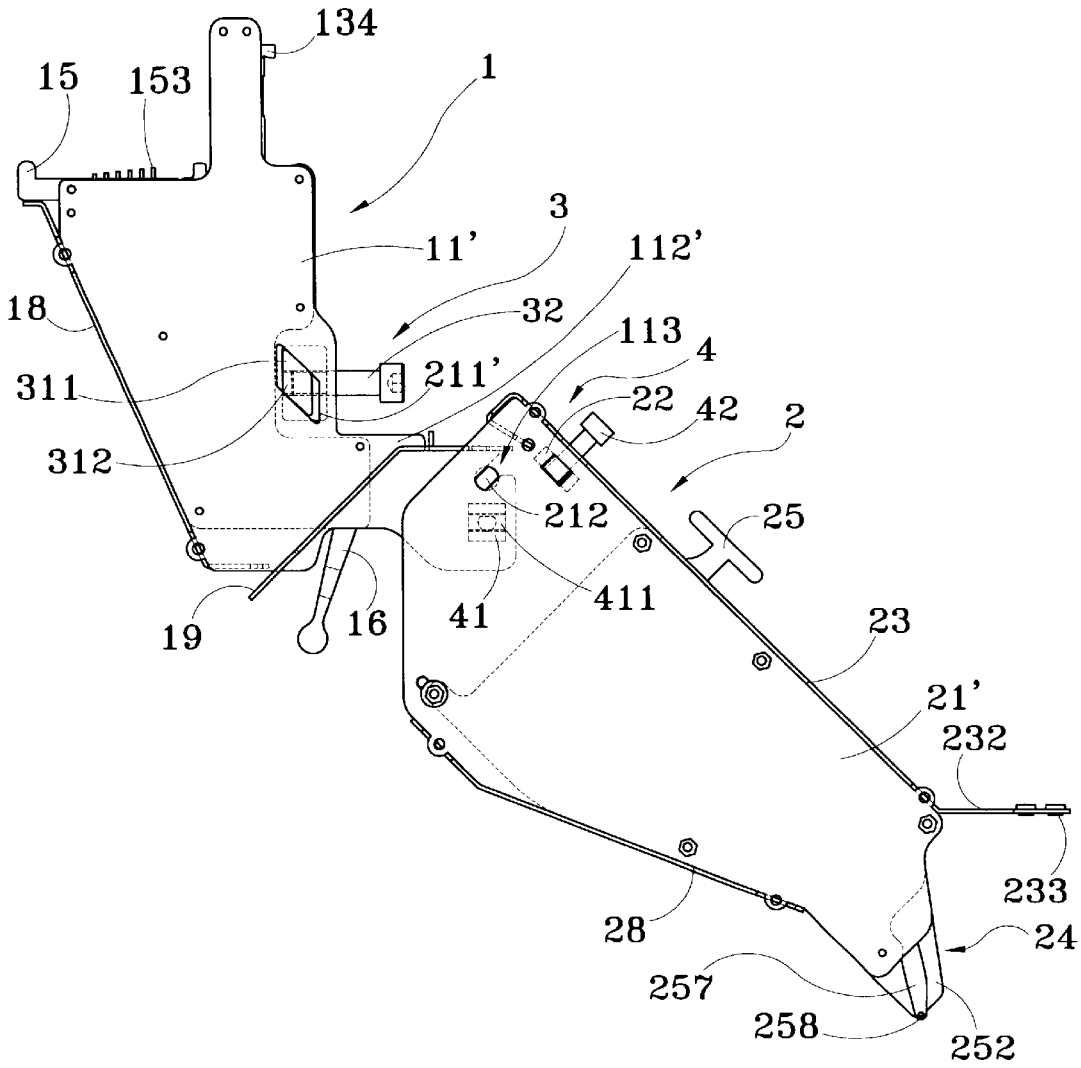
Figure 4C:
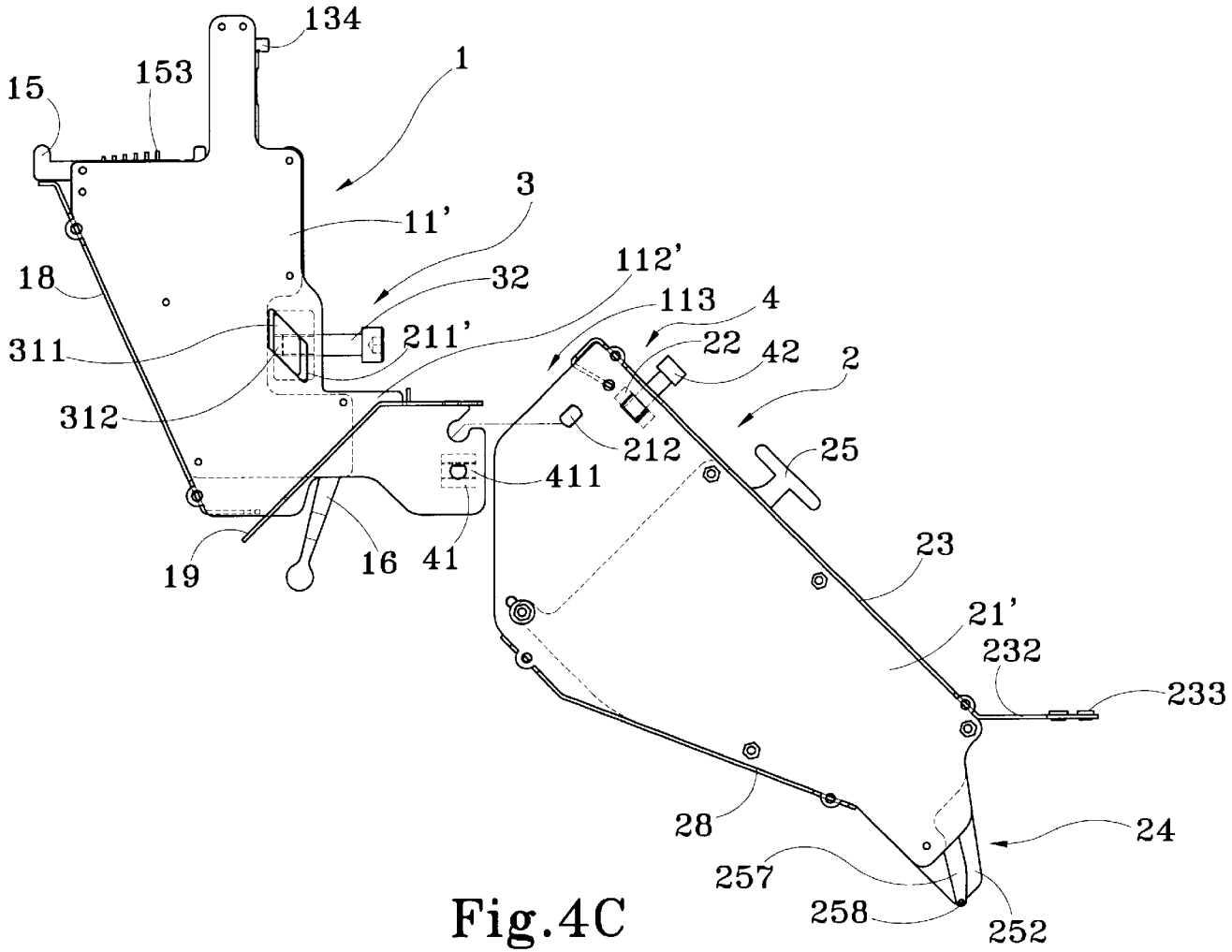
Figure 4D:
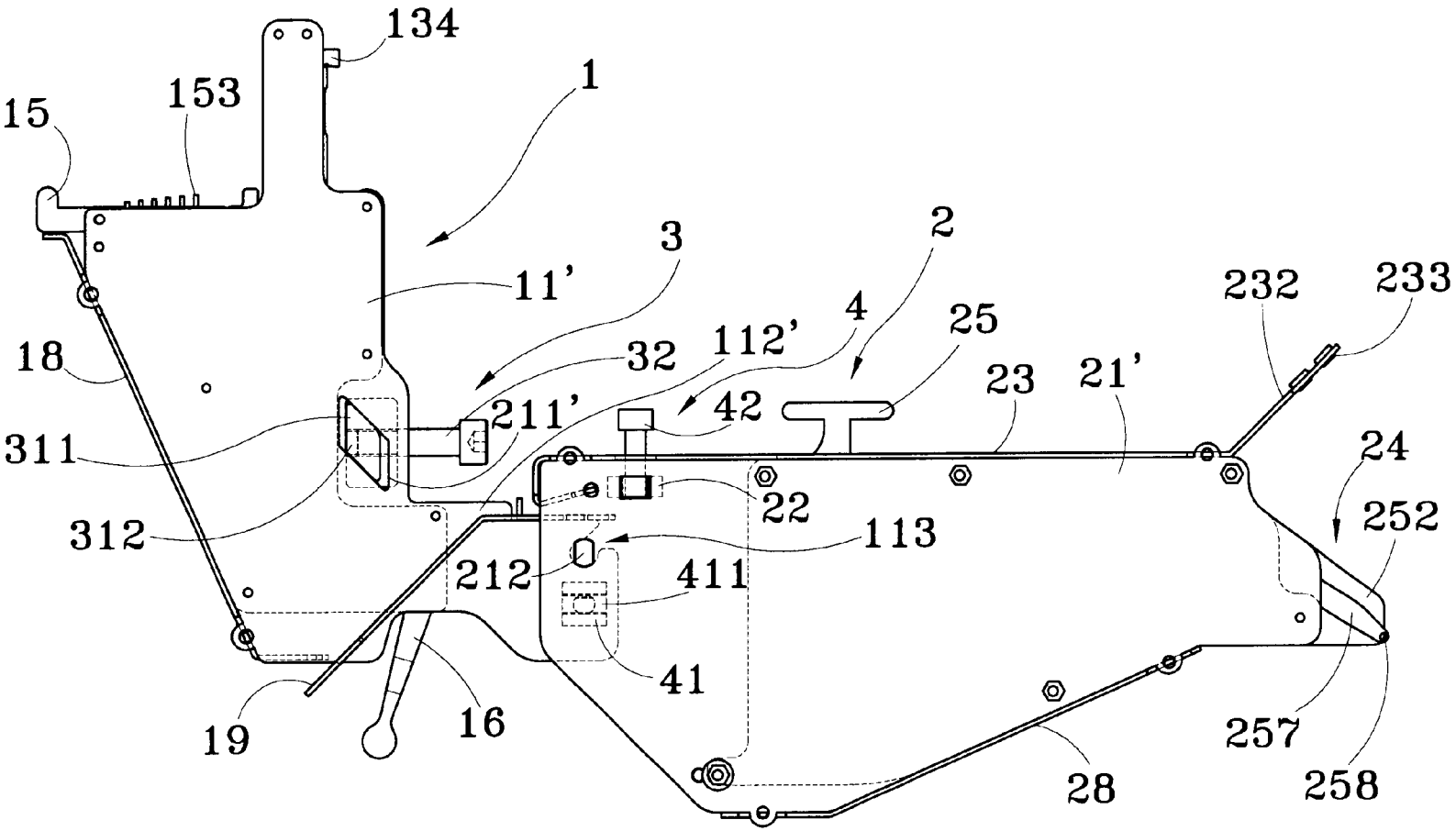

The elastic element 17 (as shown in FIG. 3A) has one end fastened to the interior of the control mechanism 1 and other end pushed one side of the yarn push blade 13. The dividing plate 12, yarn push blade 13, color selection press blade 14, color selection blade 15, linkage blade 16 and elastic element 17 are fastened to the interior of the two outer plates 11 and 11' by means of fasteners (not shown in the drawings). Then a first side plate 18 is fastened to the rear side of the two outer plates 11 and 11', and a blocking plate 19 is fastened to the front side of the control mechanism 1 to harness the operation mechanism 2 after the control mechanism 1 and the operation mechanism 2 have been assembled, and to prevent the operation mechanism 2 from wobbling.

In addition, the operation mechanism 2 has two side plates 21 and 21' which have respectively a hole 211 and 211' corresponding to each other for pivotally engaging with an axle 212. The axle 212 may be pivotally engaged with the pivotal connecting troughs 113 and 113'. There is an anchor block 22 and a shield plate 23 located between the side plates 21 and 21' that have respectively an opening 221 and 231 corresponding to each other. The shield plate 23 has a front end extended to form a yarn threading plate 232 which has at least one yarn aperture 233 for threading a color yarn (not shown in the drawings). Furthermore, between the side plates 21 and 21', there are at least one yarn cutting blade 24, one yarn feeding blade 25, one dividing blade 26 and one movable cutter 27 fastened therein. The yarn cutting blade 24 has a plurality of holes 241 for fastening to the interior of the operation mechanism 2, a yarn cutting section 242 located on a front end thereof to cut off the yarn picked up by the movable cutter 27, and a moving space 243 formed at a selected location.

The yarn feeding blade 25 is located in the operation mechanism 2 and has a moving section 251. The moving section 251 has a first slot 252 and a second slot 253 to enable the moving section 251 to move, a pivotal connection trough 254 formed on one end thereof to pivotally engage with the second pivotal connection end 163' of the linkage blade 16, a moving space 255 located below the first slot 252 for housing a moving element 256 which fastens to one end of the movable cutter 27. When the moving space 255 is moved for a displacement and drives the moving element 256, the movable cutter 27 also is driven to move. In addition, the moving section 251 extends on a selected location to form a yarn feeding rod 257 which has a front end forming an aperture 258 for threading a yarn.

The dividing blade 26 is mounted in the operation mechanism 2, and is located between the linkage blade 16 and the yarn feeding blade 25 to enable each yarn feeding blade 25 to form an operating space for the movable cutter 27.

The movable cutter 27 is located in the operation mechanism 2 and has a hole 271 for fastening to the moving element 256 and an opening 272 to enable the movable cutter 27 to move. The movable cutter 27 has a front end forming a yarn pickup section 273 for picking up the yarn delivered by the yarn feeding blade 25. The yarn then is cut off by the yarn cutting section 242 at the front end of the yarn cutting blade 24. The yarn being cut is clamped between the yarn cutting blade 24 and the movable cutter 27. Between the two side plates 21 and 21', there is at least one set of the yarn cutting blade 24, the yarn feeding blade 25, the dividing blade 26 and the movable cutter 27 fastened therein in such an order. Then the operation mechanism 2 is fastened to a second side plate 28 to become finished.

The adjusting mechanism 3 includes a sliding block 31 and an adjusting element 32. The sliding block 31 has an adjusting hole 311 for engaging with the adjusting element 32 and a pair of sliding sections 312 located on two sides of the sliding block 31 corresponding to each other. The sliding sections 312 are fastened to the first openings 111 and 111' located on the two outer plates 11 and 11'. When the control mechanism 1 is mounted onto an anchor ring 30 of the circular knitting machine (as shown in FIG. 3A), turning the adjusting element 32, the sliding sections 312 of the sliding block 31 may slide in the first openings 111 and 111' to adjust the control mechanism 1.

The release mechanism 4 includes a fastener 41 located in the operation mechanism 2 and a release element 42 running through the openings 221 and 231. The fastener 41 has a coupling section 411 to engage with the release element 42. After the release element 42 is separated from the fastener 41, the operation mechanism 2 may be adjusted or removed. By means of the aforesaid construction, the striping apparatus of the invention is built.

Refer to FIGS. 3A through 3D for the operation of striping apparatus of the invention. As shown in the drawings, the striping apparatus is installed on the circular knitting machine. When the knitting needles 51 of the color selection device 5 press the jutting end 153 of the color selection blade 15, the bucking section 152 of the color selection blade 15 slides below the press end 142 of the color selection press blade 14, and the color selection press blade 14 does not press the yarn push blade 13. The elastic force of the elastic element 17 pushes the yarn push blade 13 away. Consequently, the second lug 134' of the yarn push blade 13 is pushed by the yarn releasing cam 7 and result in the linkage blade 16 being moved when the yarn push blade 13 is being pushed away. The linkage blade 16 in turn pushes the yarn feeding blade 25, and the moving section 251 drives the yarn feeding rod 257 to feed the yarn to the knitting needle (not shown in the drawings). Meanwhile the moving element 256 is moved away from the slant surface of the moving space 255, and the yarn pickup section 273 of the movable cutter 27 extends outside the operation mechanism 2 to release the yarn.

When the color selection blade 15 is driven by the reset cam 52 to its original condition, or the knitting needles 51 of the color selection device 5 do not press the jutting end 153 of the color selection blade 15, the bucking section 152 of the color selection blade 15 presses the color selection press blade 14. As a result, the press end 142 of the color selection press blade 14 presses the fin 133 of the yarn push blade 13, and the first lug 134 of the yarn push blade 13 extends outside the two outer plates 11 and 11'. The first lug 134 is pushed by the yarn receiving cam 6, and the yarn push blade 13 is pulled back. Consequently, the linkage blade 16 is driven to move the yarn feeding blade 25. And the moving section 251 drives the yarn feeding rod 257 inside the operation mechanism 2. While the yarn feeding blade 25 is moved into the operation mechanism 2, the moving element 256 is driven by the slant surface of the moving space 255 to retract the movable cutter 27 into the operation mechanism 2.

While the movable cutter 27 is retracted into the operation mechanism 2, the yarn pickup section 273 of the movable cutter 27 picks up the yarn, and the yarn cutting section 242 of the yarn cutting blade 24 cuts off the yarn. The yarn being cut is clamped between the yarn cutting section 242 and the yarn pickup section 273 for yarn feeding operation in the next cycle. By means of the operations set forth above, the fabric may be knitted with a desired jacquard pattern and contain many different colors.

Referring to FIGS. 4A through 4D for another type of operation of the striping apparatus of the invention. As shown in the drawings, when there is a need to adjust or reinstall the needle dial, needle cylinder, knitting needles, sinker plate, saddle cam, cam and other components of the circular knitting machine, or to thread colored yarns, unfasten the release element 42 of the release mechanism 4 from the fastener 41, and turn the operation mechanism 2 to align the upper and the lower surfaces of the axle 212 with the notch of the connecting troughs 113 and 113', the operation mechanism 2 may be separated from the control mechanism 1.

In the event that the upper and the lower surfaces of the axle 212 is turned excessively against the notch of the connecting troughs 113 and 113', the operation mechanism 2 may be turned in normal to the control mechanism. Such a design makes installation and removing of the striping apparatus easier, and is more convenient for the operators or repair technicians when doing replacements, repairs, and adjustments of other components, or removing the floss.

Figure 5:
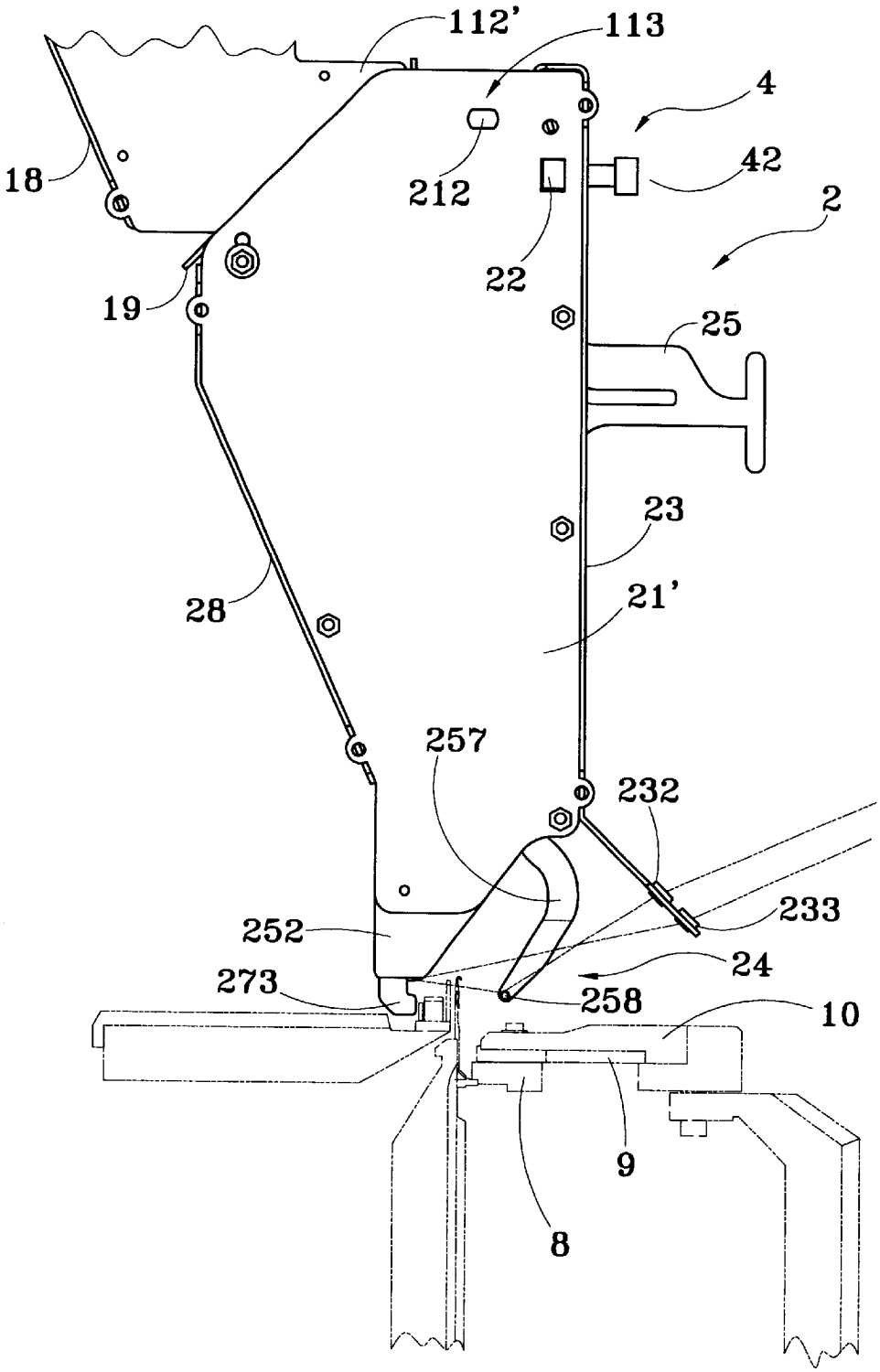
FIG. 5 is a schematic view of another embodiment of the invention.

Refer to FIG. 5 for another embodiment of the invention, the redesigned striping apparatus enables the circular knitting machine to have more space to change another set of needle dial 8, sinker plate 9 and push needle cam 10 so that the circular knitting machine can do knitting operations to produce single or double pile fabrics, or double or single pattern plush fabrics, and the producers can make many combinations of knitting products.

What is claimed is:

1. A striping apparatus for a circular knitting machine, comprising:

a control mechanism including two outer plates, at least one dividing plate located between the two outer plates, and a yarn push blade, a color selection press blade, a color selection blade, a linkage blade and an elastic element pivotally engaged with each dividing plate, the two outer plates further having respectively one end extended to form a connecting section which has a pivotal connecting trough formed thereon corresponding to each other; and an operation mechanism pivotally engaged with one end of the connecting section having two side plates which fasten therebetween at least one yarn cutting blade, one yarn feeding blade, one dividing blade and one movable cutter, and engage with an axle which is pivotally coupled with the pivotal connecting troughs;

wherein the striping apparatus is mounted onto the circular knitting machine and is controlled by a yarn releasing and receiving cam and a color selection device for feeding different colored yarns to knitting needles to produce striped jacquard knitting fabrics.

2. The striping apparatus for a circular knitting machine of claim 1, wherein the yarn push blade has a front end with a pivotal connection trough formed thereon, an opening formed on a selected location, a fin located on another end thereof, and a first lug and a second lug located on yet another end thereof corresponding to each other.

3. The striping apparatus for a circular knitting machine of claim 1, wherein the color selection press blade has an aperture and a jutting press end located on one end thereof.

4. The striping apparatus for a circular knitting machine of claim 1, wherein the color selection blade has a hole, a front end formed a bucking section and a jutting end located on another end thereof.

5. The striping apparatus for a circular knitting machine of claim 1, wherein the linkage blade has a bore and two arms extended from two sides of the bore, the two arms having respectively one end formed a first pivotal connection end and a second pivotal connection end.

6. The striping apparatus for a circular knitting machine of claim 1, wherein the elastic element has one end fastened to the interior of the control mechanism and other end pushed one side of the yarn push blade.

7. The striping apparatus for a circular knitting machine of claim 1, wherein the control mechanism includes two outer plates which have respectively, a first opening formed thereon corresponding to each other.

8. The striping apparatus for a circular knitting machine of claim 1, wherein the two side plates of the operation mechanism fastened therebetween an anchor block and a shield plate which have respectively an opening corresponding to each other, the shield plate having a front end extended to form a yarn threading plate which has at least one yarn aperture.

9. The striping apparatus for a circular knitting machine of claim 1, wherein the yarn cutting blade has a plurality of holes, a yarn cutting section located on a front end thereof, and a moving space formed at a selected location.

10. The striping apparatus for a circular knitting machine of claim 1, wherein the yarn feeding blade has a moving section which has a first slot and a second slot, a pivotal connection trough formed on one end thereof, a moving space located below the slots for housing a moving element, and a yarn feeding rod extended from a selected location thereof, the yarn feeding rod having a front end formed an aperture.

11. The striping apparatus for a circular knitting machine of claim 1, wherein the movable cutter has a hole and an opening to allow the movable cutter to move, and a front end formed a yarn pickup section.

12. The striping apparatus for a circular knitting machine of claim 1 further having an adjusting mechanism which includes a sliding block and an adjusting element, the sliding block having an adjusting hole for engaging with the adjusting element and a pair of sliding sections located on two sides thereof corresponding to each other.

13. The striping apparatus for a circular knitting machine of claim 1 further having a release mechanism which includes a fastener and a release element, the fastener having a coupling section to engage with the release element.

14. The striping apparatus for a circular knitting machine of claim 1 further having a side plate fastened to a rear side of the control mechanism.

15. The striping apparatus for a circular knitting machine of claim 1 further having a blocking plate fastened to the control mechanism.

* * * * *